United States Patent [19]

Teichert et al.

[11] 4,246,457

[45] Jan. 20, 1981

[54] ELECTRICAL SWITCH CONSTRUCTION, PARTS THEREFOR AND METHODS OF MAKING THE SAME

[75] Inventors: Allen L. Teichert, Placentia; Richard W. McKinney, Lakewood, both of Calif.; Edgar E. Marquis, Newtown, Conn.

[73] Assignee: Robertshaw Controls Company, Richmond, Va.

[21] Appl. No.: 3,995

[22] Filed: Jan. 16, 1979

[51] Int. Cl.[3] ..... H01H 9/02

[52] U.S. Cl. ..... 200/303; 29/622; 335/151; 335/202

[58] Field of Search ..... 335/151, 153, 154, 202; 200/281, 293, 303; 29/622

[56] References Cited

U.S. PATENT DOCUMENTS

| | | | |
|---|---|---|---|
| 2,947,432 | 8/1960 | Marcel | 215/321 |
| 3,211,854 | 10/1965 | Bengtsson | 335/202 X |
| 3,406,361 | 10/1968 | LeMauviel | 335/202 X |
| 3,512,113 | 5/1970 | Kirkendall | 200/303 X |
| 3,518,391 | 6/1970 | Hipple | 200/303 |
| 3,597,564 | 8/1971 | Lewis | 200/303 X |
| 3,611,218 | 10/1971 | Fujita | 335/202 |
| 3,618,136 | 11/1971 | Fujita | 335/202 |
| 3,872,996 | 3/1975 | Dogliotti | 215/321 X |
| 3,883,705 | 5/1975 | Sebastian et al. | 200/303 |
| 4,027,776 | 6/1977 | Douglas | 215/355 X |

*Primary Examiner*—Stephen Marcus

*Attorney, Agent, or Firm*—Candor, Candor & Tassone

[57] ABSTRACT

An electrical swtich construction having a self-contained and completely operable electrical switch assembly disposed in a protective envelope and having leads extending from the assembly and projecting externally through an opening in one end of the envelope. A removable end closure is carried by the envelope and closes the opening of the one end thereof, the end closure having apertures therethrough and removably receiving the leads therethrough whereby the self-contained switch assembly is adapted to be carried by the end closure away from the protective envelope when the end closure is removed from the one end of the protective envelope and the self-contained switch assembly is adapted to be removed from the end closure solely by pulling the leads out of the apertures thereof.

4 Claims, 9 Drawing Figures

ELECTRICAL SWITCH CONSTRUCTION, PARTS THEREFOR AND METHODS OF MAKING THE SAME

BACKGROUND OF THE INVENTION

1. Field of the Invention

This invention relates to an improved electrical switch construction and to a method of making the same as well as to improved parts for such an electrical switch construction and methods of making such parts.

2. Prior Art Statement

It is known to provide an electrical switch construction having self-contained and completely operable electrical switch assembly disposed in a protective envelope and having lead means extending from the assembly and projecting externally from the envelope out through opening means in one end of the envelope.

For example, see the prior art switch construction illustrated in FIGS. 1 and 2 of this application.

It is also known to applicants to pot wire and electrical switch supports and mount such potted wire and switch supports in glass bottles in such a manner that the potted wire and switch supports close the open ends of the glass bottles.

SUMMARY OF THE INVENTION

It is known to provide an electrical switch in a sealed glass envelope to protect the switch contacts from atmospheric contamination and operate such electrical switch by moving an externally mounted magnet toward and away from the switch armature that is in the envelope, the magnet being carried by a bimetal thermal sensor so that the sealed electrical switch can be utilized in a room thermostat construction or the like for a heating and cooling system.

However, such a sealed glass envelope switch construction not only is relatively expensive to manufacture, but also if, during the course of manufacture, rework or salvage of the switch parts would be desirable, it is quite difficult to achieve such rework or salvage after the sealing of the glass envelope is completed.

Accordingly, it is a feature of this invention to provide an envelope protected electrical switch assembly that provides adequate dust and particle protection as well as easy disassembly for switch rework or replacement during the manufacturing thereof.

In particular, one embodiment of this invention provides an electrical switch construction having a self-contained and completely operable electrical switch assembly disposed in a protective envelope and having lead means extending from the assembly and projecting externally from the envelope out through opening means in one end of the envelope. A removable end closure is carried by the envelope and closes the opening means of the one end thereof. The end closure has aperture means therethrough and removably receives the lead means therethrough whereby the self-contained switch assembly is adapted to be carried by the end closure away from the protective envelope when the end closure is removed from the one end of the protective envelope and the self-contained switch assembly is adapted to be removed from the end closure solely by pulling the lead means out of the aperture means thereof.

Accordingly, it is an object of this invention to provide an improved electrical switch construction having one or more of the novel features of this invention as set forth above or hereinafter shown or described.

Another object of this invention is to provide a method of making such a switch construction, the method of this invention having one or more of the novel features of this invention as set forth above or hereinafter shown or described.

Another object of this invention is to provide an improved part for such an electrical switch construction, the improved part of this invention having one or more of the novel features of this invention as set forth above or hereinafter shown or described.

Another object of this invention is to provide a method of making such an improved part, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
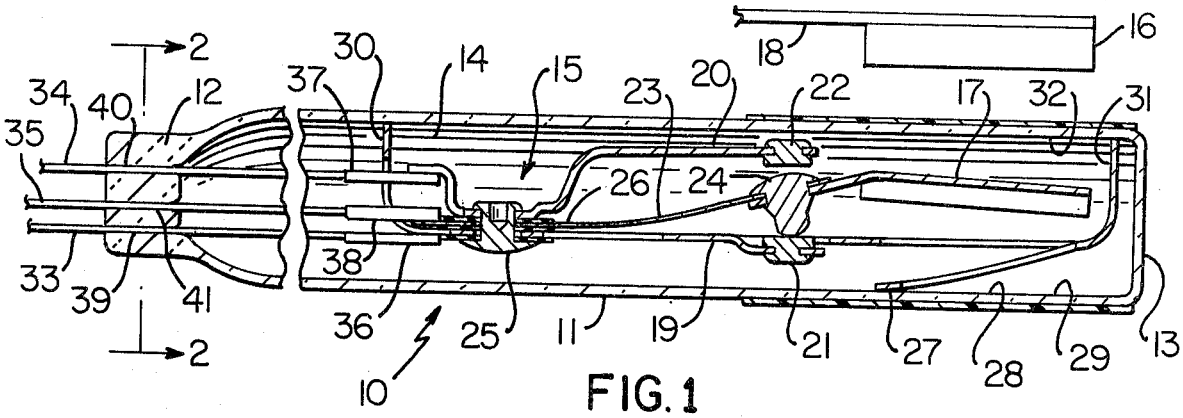
FIG. 1 PRIOR ART
FIG. 1 is a cross-sectional view illustrating a prior art electrical switch construction.
Figure 2:
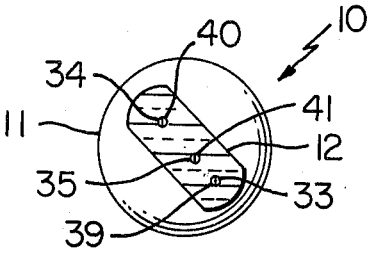
FIG. 2 PRIOR ART
FIG. 2 is a cross-sectional view taken on line 2—2 of FIG. 1.

A conventional magnetically operated electrical switch construction is generally indicated by the reference numeral 10 in FIGS. 1 and 2 and comprises a protective, substantially tubular glass envelope 11 having opposed closed and sealed ends 12 and 13 to define a chamber 14 therein that contains an electrical switch assembly that is generally indicated by the reference numeral 15 and is adapted to be operated by a magnet 16 that is mounted externally to the protective envelope 11 so as to be movable toward and away from an armature 17 of the switch assembly 15 in any suitable manner, such as by being mounted on a bimetal member 18 so as to be responsive to temperature whereby the electrical switch construction 10 can perform an operating function for a room thermostat construction or the like in a manner well known in the art.

The electrical switch assembly 15 includes two stationary switch blades 19 and 20 respectively carrying fixed electrical contact means 21 and 22. The armature 17 is carried by a movable switch blade 23 having a contact means 24 which is adapted to be moved against and between the contacts 21 and 22 in relation to the attraction of the armature 17 for the magnet 16.

In particular, the switch blades 19, 20 and 23 can be fastened together by a suitable rivet means 25 which provides a pivot point 26 for the switch blade 23 so that when the magnet 16 is moved toward the envelope 11 to attract the armature 17 toward the same, the upwardly moving armature 17 bends the switch blade 23 to move the movable contact 24 out of contact with the contact 21 and into contact with the contact 22. When the magnet 16 moves away from the envelope 11 a sufficient distance, the magnetic influence of the magnet 16 on the armature 17 is diminished and the natural spring force of the switch blade 23 returns the switch blade 23 downwardly so as to move the movable contact 24 out of contact with the contact 22 and into normal closed contact with the contact 21 as illustrated.

The switch blade 19 can be so constructed and arranged that the same has a spring tongue 27 for engaging against one side 28 of the internal peripheral surface 29 of the glass envelope 11 while other tongues 30 and 31 of the switch blade 19 engage against the other side 32 of the internal peripheral surface 29 of the envelope 11 to properly position and hold the switch assembly 15 in the chamber 14 of the protective envelope 11.

In order to provide external electrical interconnection to the switch blades 19, 20 and 23 of the switch assembly 15, electrical leads 33, 34 and 35 are respectively interconnected to lead connectors 36, 37 and 38 of the respective lefthand ends of the switch blades 19, 20 and 23 as illustrated and project externally of the envelope 11 through respective openings 39, 40 and 41 formed in the end 12 of the protective envelope 11 through the fusing of the end 12 to the leads 33, 34 and 35.

In particular, during the manufacturing of the electrical switch construction 10, the end 12 of the envelope 11 is formed by heat and pressure to fuse the end 12 around the leads 33, 34 and 35 to seal close the end 12 and, thus, the openings 39, 40 and 41 so that the chamber 14 can be hermetically sealed from the atmosphere exterior to the envelope 11.

However, in order to perform such fusing operation on the end 12 of the glass envelope 11 during the manufacturing of the switch construction 10, the leads 33, 34 and 35 must be formed of a special metal alloy in order to provide good electrical conductivity and the ability to be bonded to the glass of the envelope 11 when heat and pressure are applied to fuse the glass to the metal of the leads 33, 34 and 35. In addition, the lead connectors 36, 37 and 38 for the switch blades 19, 20 and 23 of the switch assembly 15 must be also made of a special metal alloy in order to permit the lead wires 33, 34 and 35 to be welded thereto as illustrated, all of which adds considerable time and expense to the making of the electrical construction 10.

Further, as previously set forth, because the leads 33, 34 and 35 are fused to the end 12 of the protective envelope 11, if rework or salvage of the switch assembly 15 is advantageous during the manufacture of the switch construction 10 because of the malfunctioning of a part thereof or the like, it is quite difficult to subsequently remove the switch assembly 15 from the sealed envelope 11 without adding considerably to the cost of such a salvaging or rework operation.

Therefore, it is a feature of this invention to provide an envelope protected electrical switch assembly which can be operated by an externally mounted magnet or the like and will readily permit easy assembly and disassembly of the switch construction for switch rework or replacement during the manufacturing thereof so as to overcome the inherent disadvantages of the prior art electrical switch construction 10 previously described while still having the advantages thereof.

In particular, one embodiment of such an electrical switch construction of this invention is generally indicated by the reference numeral 10A in FIGS. 3–7 and parts thereof similar to the prior art switch construction 10 are indicated by like reference numerals followed by the reference letter "A".

Figure 3:
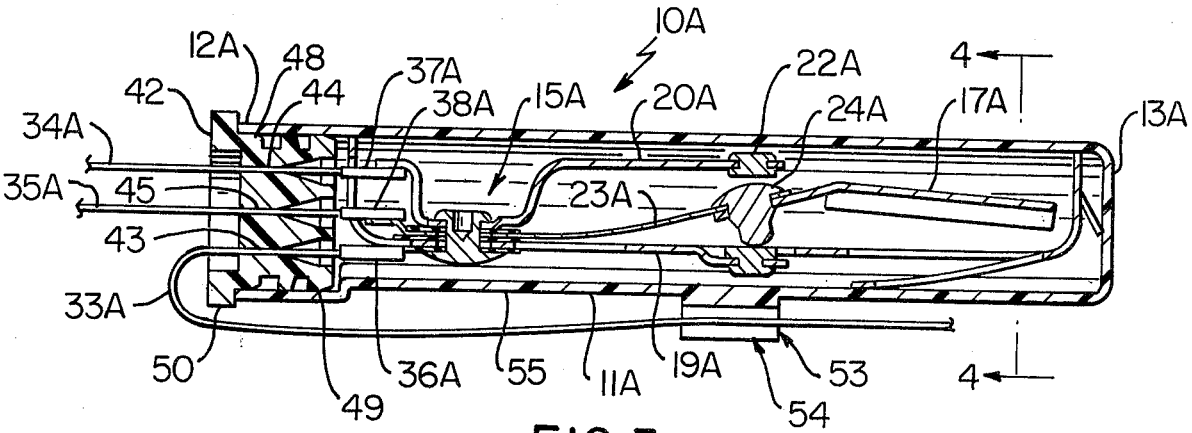
FIG. 3 is a view similar to FIG. 1 and illustrates one embodiment of the improved electrical switch construction of this invention.

As illustrated in FIG. 3, it can be seen that the electrical switch construction 10A of this invention can utilize an electrical switch assembly 15A therein which is substantially identical to the switch assembly 15 previously described to be operated by an externally operated magnet means (not shown) for the same reasons and in the same manner as previously described.

However, the electrical switch construction 10A of this invention includes a protective envelope 11A which can be formed of moldable plastic material rather than glass and while the same has a closed end 13A, the envelope 11A has a fully opened end 12A that is adapted to be opened and closed by a readily removable end closure 42 of this invention in a manner hereinafter set forth, the end closure 42 having suitable apertures 43, 44 and 45 passing therethrough and respectively telescopically receiving the electrical leads 33A, 34A and 35A for the switch assembly 15A.

Figure 5:
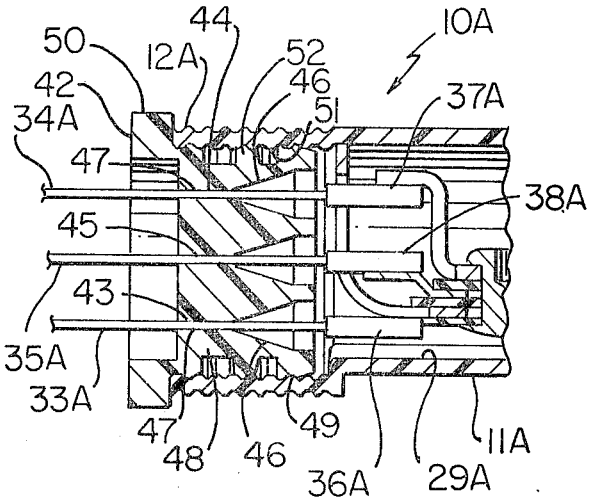
FIG. 5 is an enlarged, fragmentary view of one end of the electrical switch construction of FIG. 3.

The end closure 42 can be formed of molded, resilient plastic material and it can have the apertures 43, 44 and 45 molded therethrough in the configuration as illustrated in FIG. 5 wherein the right-hand ends of the apertures 43, 44 and 45 are provided with enlarged conical sections 46 whereby the leads 33A, 34A and 35A can be readily inserted therein to be pulled through the apertures 43, 44 and 45 from the right side of the end closure 42 to the left side thereof as illustrated. In this manner, the leads 33A, 34A and 35A are readily detachable from the end closure 42 although the lefthand ends 47 of the apertures 43, 44 and 45 can normally compressively retain the leads 33A, 34A and 35A through a press fit relation of the end closure 42 with the leads 33A, 34A and 35A.

In addition, the end closure 42 has a plug means or portion 48 which is received internally into the envelope 11A so that the outer peripheral surface 49 of the plug means 48 will be disposed in radial compression against the internal peripheral surface 29A of the envelope 11A to further cause a compression of the end closure 42 about the leads 43, 44 and 45 at the left-hand ends 47 of the apertures 43, 44 and 45 so as to not only prevent dust and the like from entering into the envelope 11A through the apertures 43, 44 and 45, but also to firmly hold the leads 33A, 34A and 35A in their assembled relation with the end closure 42 so that the switch means 15A will not be moved inside the envelope 11A during handling of and/or engagement with the leads 33A, 34A and 35A externally of the switch construction 10A.

If desired, the end closure 42 can be provided with an outwardly directed annular flange 50 which is adapted to abut against the end of 12A of the envelope 11A to limit the degree of insertion of the plug means 48 into the envelope 11A, the flange 50 also assisting the end closure 42 in preventing dust and the like from entering into the chamber 14A through the end 12A of the envelope 11A.

In order to more firmly secure the end closure 42 in its closed position against the open end 12A of the envelope 11A, not only can the end 12A of the envelope 11A be provided with internal rib means 51 as illustrated in FIG. 5, but also the plug means 48 can be provided with external rib means 52 which will cooperate with the internal rib means 51 to tend to hold the plug means 48 in its inserted press-fit position in the envelope 11A. However, the end closure 42 can be readily removed from the envelope 11A by merely pulling outwardly on the same to not only remove the end closure 42 from the envelope 11A, but also to carry the switch assembly 15A therewith. Subsequently, the removed end closure 42 can be removed from the leads 33A, 34A and 35A by merely pulling the leads 33A, 34A and 35A out of the apertures 43, 44 and 45 of the end closure 42.

Because the leads 33A, 34A and 35A are not fused to the end closure 42 of the switch construction 10A of this invention,the lead wires 33A, 34A and 35A need not be of the previously mentioned special alloy that is required in the switch construction 10 previously described as the leads 33A, 34A and 35A can be merely copper wires or the like that can be directly welded to the switch blades 19A, 20A and 23A without requiring the particular metallic alloy lead connectors 36A, 37A and 38A even though such connectors 36A, 37A and 38A are illustrated in FIG. 3. However, since the switch assemblies 15 are normally already made with the connectors 36, 37 and 38 thereon, it can be seen that the leads 33A, 34A and 35A can be readily attached thereto. Nevertheless, it is to be understood that it is the intent of this invention to also utilize the switch assemblies 15A without the connectors 36A, 37A and 38A thereon so that the leads 33A, 34A and 35A may be directly welded or attached to the switch blades 19A, 20A and 23A without the connectors 36A, 37A and 38A, if desired.

In fact, any other suitable type of switch can be utilized in the envelope 11A and the switch assembly 15A is merely being illustrated as an example of such a suitable switch.

Thus, it can be seen that the cost of the materials in making the lead means 33A, 34A and 35A and their attachment with the switch assembly 15A is considerably less than is required by the switch construction 10 previously described because of the requirement of having the glass envelope 11 fused to such lead means.

Further, it can be seen that by making the switch assembly 15A readily removable from the end closure 42 and the end closure 42 readily removable from the envelope 11A, switch rework and replacement of switch parts can readily be made at any time during the manufacture of the switch construction 10A of this invention, a feature not present in the prior art switch construction 10 previously described for the reasons previously set forth.

Since the envelope 11A need not be formed of glass, the same can be formed of moldable plastic material and, in this manner, the envelope 11A can be provided as a one-piece structure and have various means integrally formed therewith during the molding of the envelope 11A.

Figure 4:
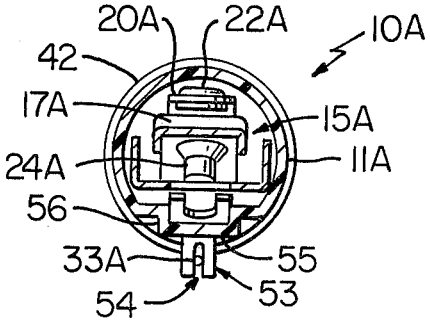
FIG. 4 is a cross-sectional view taken on line 4—4 of FIG. 3.

For example, the envelope 11A can be provided with one or more clip means that is generally illustrated by the reference numeral 53 each of which provides slot means 54 therebetween and in which an external portion of one of the leads 33A, 34A or 35A can be press-fitted in the manner provided by the lead 33A in FIGS. 3 and 4 to hold the external portion of that lead 33A closely adjacent to the envelope 11A for any desired attachment purposes or the like.

Figure 6:
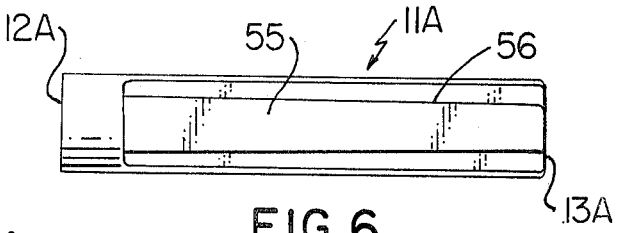
FIG. 6 is a reduced view illustrating one side of the protective envelope of the switch construction of FIG. 3.
Figure 7:
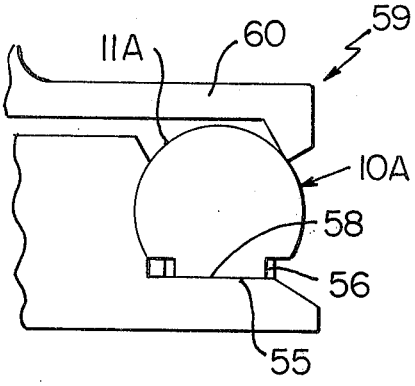
FIG. 7 is a fragmentary end view illustrating the electrical switch construction of FIG. 3 mounted in a supporting structure.

In addition, all or part of the envelope 11A can be provided with integral external locating surface means thereon which will permit the switch construction 10A to be mounted in a desired manner by utilizing such surface means as a locating mounting means therefor. For example, the envelope 11A is provided with a flat surface means 55 substantially throughout the entire length thereof with such surface means 55 being defined by an outwardly projecting abutment 56 that tapers from the right to the left thereof as illustrated in FIGS. 6 and 7 to readily permit the switch construction 10A to be mounted against a flat mounting surface 58 of a mounting structure 59 so that rotation of the switch construction 10A in such mounting means 59 will not be permitted, the mounting means 59 including a flexible arm 60 for holding against the envelope 11A as illustrated.

In this manner, the longitudinal position of the mounted switch construction 10A can be adjusted to thereby adjust the position of the armature 17A thereof relative to the magnet that is carried adjacent to the mounting means 59 to provide a desired thermostat differential for the switch construction 10A as is well known in the art.

In addition, by providing the loading surface 55 on the envelope 11A of the switch construction 10A, the exact rotational position of the switch construction 10A is assured so that the magnet utilized to operate the armature 17A thereof will not be out of alignment therewith to cause the switch contacts 24A and 22A to be pulled together with a twisting action on the switch blade 23A which would tend to wear out the switch blade 23A more rapidly than if the same were in its true rotational position relative to such magnet.

In addition to the mounting surface means 55 and lead clip means 53 previously described, it is to be understood other integral items could be molded at the time the envelope 11A is being formed so as to facilitate the mounting and/or use of the switch construction 10A. For example, a desirable magnet gap, or lock up, can be provided by molding a stop on the envelope 11A. Also, the molded plastic envelope 11A, can readily provide configurations to adapt to other structures which might be desirable, such as, for example, a detent spring to engage and modify the magnet-armature relationship.

Thus, many variations for the envelope 11A can be provided while still remaining a one-piece structure, a feature not available for the glass envelope 11 previously described.

Therefore, it can be seen that the switch construction 10A of this invention can be formed in a relatively simple and inexpensive manner by the method of this invention, namely, forming the envelope 11A in the desired configuration thereof and forming the end closure 42 so that the end closure 42 can have the leads 33A, 34A and 35A thereof readily pulled into and through the apertures 43, 44 and 45 thereof to the desired telescoped relation whereby the switch assembly 15A can thereafter or before be attached to the leads 33A, 34A and 35A so as to be carried with the end closure 42 to be assembled into the envelope 11A. For example, the switch assembly 15A can be first inserted through the open end 12A, of the envelope 11A until the plug means 48 of the end closure 42 is fully compressibly inserted into the end 12A and the flange 50 abuts against the end 12A in the manner illustrated in FIGS. 3 and 5.

Thus, it can be seen that the assembly method is relatively simple and inexpensive and the resulting switch construction 10A can be readily disassembled my merely pulling out the end closure 42 to withdraw the switch assembly 15A from the envelope 11A so that the lead means 33A, 34A and 35A can be readily pulled out of the apertures 43, 44 and 45 to disassemble the switch assembly 15A from the end closure 42 for rework or replacement as the case may be.

Accordingly, it can be seen that the switch construction 10A of this invention can be formed by the method of this invention in a relatively simple and inexpensive manner as set forth above to operate in a manner now to be described.

As previously stated, once the switch configuration 10A is formed in the manner illustrated in FIG. 3, the same can be readily assembled into the receiving structure 59 as illustrated in FIG. 7 by merely inserting the switch construction 10A under the resilient arm 60 in such a manner that the flat surface 55 of the abutment means 56 of the envelope 11A will be in engagement with the flat surface 58 whereby the longitudinal position of the envelope 11A relative to the mounting means 59 and, thus, relative to an externally mounted magnet (not shown) can be readily adjusted to set the desired thermostat differential for the assembly. Thereafter, movement of the magnet relative to the envelope 11A causes the attraction of the armature 17A toward the same or away from the same as the case may be so that the switch blade 23A will place the movable contact 24A either in contact with the lower fixed contact 21A or the upper fixed contact 22A in the manner previously described to provide a switching function between the leads 33A and 34A or 35A and 24A for any desired purpose.

While the switch construction 10A of this invention has been previously described with the end closure 42 having a plug means 48 for insertion within the envelope 11A, it may be desirable to provide an end closure which mounts externally to the envelope 11A so as to provide for a shorter envelope 11A having the same size switch assembly therein.

Figure 8:
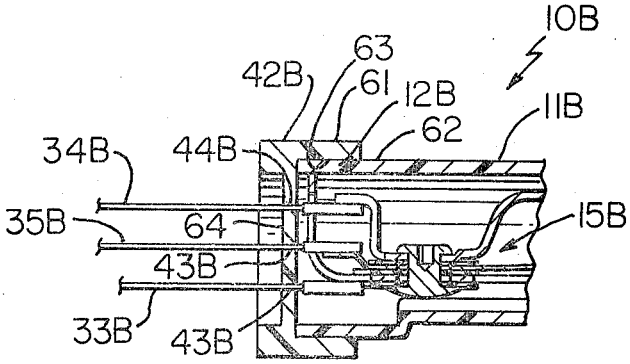
FIG. 8 is a view similar to FIG. 5 and illustrates another embodiment of the electrical switch construction of this invention.

For example, reference is now made to FIG. 8 wherein another electrical switch construction of this invention is generally indicated by the reference numeral 10B and parts thereof similar to the switch construction 10A previously described are indicated by like reference numerals followed by the reference letter "B".

As illustrated in FIG. 8, the end closure 42B is provided with a tubular extension 61 which is adapted to telescope over the end 12B of the envelope 11B in a press-fit manner to grip against the external peripheral surface 62 thereof and thereby hold the end closure 42B to the envelope 11B while still being readily movable therefrom. If desired, the internal peripheral surface 63 of the tubular extension 61 can be provided with internal rib means thereon (not shown) which would cooperate with external rib means (not shown) on the surface 62 of the envelope 11B (see FIG. 5 for such external rib means for the envelope 11A).

In this manner, the end closure 42B can be readily assembled to or disassembled from the envelope 11B during the assembling of the switch assembly 15B thereto or therefrom as the case may be, the end closure 42B having a central section 64 provided with the apertures 43B, 44B and 45B therethrough that respectively receive the leads 33B, 34B and 35B therethrough without having the central portion 64 extend into the open end 12B of the envelope 11B.

However, it can be seen that the method of assembly and the operation of the switch construction 10B is substantially the same as the switch construction 10A previously described and need not be repeated.

While the end closures 42 and 42B of this invention have been described as already having the apertures 43, 44 and 45 and 43B, 44B and 45B already formed therethrough, it is to be understood that such aperture means could be formed at the same time the end closure is being assembled to a receiving envelope for the switch construction.

Figure 9:
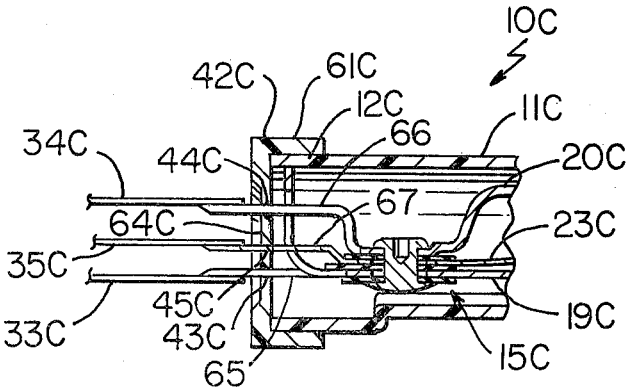
FIG. 9 is a view similar to FIG. 5 and illustrates another embodiment of the electrical switch construction of this invention.

For example, reference is now made to FIG. 9 wherein another electrical switch construction of this invention is generally indicated by the reference numeral 10C and parts thereof similar to the switch construction 10A and 10B of this invention are indicated by like reference numerals followed by the reference letter "C".

As illustrated in FIG. 9, it can be seen that the end closure 42C is provided with the outer tubular extension 61C for telescoping over the end 12C of the envelope 11C to assemble the end closure 42C thereto.

However, the central portion 64C of the end closure 42C is not provided with an aperture means passing therethrough and the switch assembly 15C has the switch blades 19C, 20C and 23C respectively provided with pointed extensions 65, 66 and 67 which are adapted to puncture or perforate through the central portion 64C of the end closure 42C when the end closure 42C is being assembled to the end 12C of the envelope 11C after the switch assembly 15C has been first inserted therein whereby the pointed projections 65, 66 and 67 form their own press-fit aperture means 43C, 44C and 45C through the end closure 42C. External lead means 33C, 34C and 35C can be subsequently attached to projections 65, 66 and 67 by welding or the like.

Thus, it can readily be seen that the end closure 42C can readily be removed from the envelope 11C to remove the switch assembly 15C therefrom for rework or replacement of parts thereof, the switch assembly 15C being removable from the end closure 42C by merely cutting off the leads 33C, 34C and 35C from the projections 65, 66 and 67, if desired.

Therefore, it can be seen that this invention provides an improved envelope protected switch construction and method of making the same as well as improved parts for such a switch construction and methods of making such improved parts.

While the forms and methods of this invention now preferred have been illustrated and described as required by the Patent Statute, it is to be understood that other forms and method steps can be utilized and still fall within the scope of the appended claims.

What is claimed is:

1. In an electrical switch construction having an electrical switch assembly disposed in a protective envelope and having lead means extending from said assembly and projecting externally from said envelope out through opening means in one end of said envelope, the improvement comprising a removable end closure carried by said envelope and closing said opening means of said one end thereof, said end closure having aperture means therethrough and removably receiving said lead means therethrough whereby said switch assembly is adapted to be carried by said end closure away from said protective envelope when said end closure is removed from said one end of said protective envelope and said switch assembly is adapted to be removed from said end closure by pulling said lead means out of said aperture means thereof, said protective envelope comprising a one-piece member, said protective envelope having integral clip means thereon holding said lead means adjacent to said protective envelope.

2. In an electrical switch construction having an electrical switch assembly disposed in a protective envelope and having lead means extending from said assembly and projecting externally from said envelope out through opening means in one end of said envelope, the improvement comprising a removable end closure carried by said envelope and closing said opening means of said one end thereof, said end closure having aperture means therethrough and removably receiving said lead means therethrough whereby said switch assembly is adapted to be carried by said end closure away from said protective envelope when said end closure is removed from said one end of said protective envelope and said switch assembly is adapted to be removed from said end closure by pulling said lead means out of said aperture means thereof, said protective envelope comprising a one-piece member, said protective envelope having integral locating surface means thereon, said locating surface means comprising an elongated tapering abutment on said protective envelope.

3. In a method of making an electrical switch construction having an electrical switch assembly disposed in a protective envelope and having lead means extending from said assembly and projecting externally from said envelope out through opening means in one end of said envelope, the improvement comprising the steps of forming a removable end closure to be carried by said envelope and close said opening means of said one end thereof, forming said end closure with aperture means therethrough, removably disposing said lead means through said aperture means whereby said switch assembly is adapted to be carried by said end closure away from said protective envelope when said end closure is removed from said one end of said protective envelope and said switch assembly is adapted to be removed from said end closure by pulling said lead means out of said aperture means thereof, forming said protective envelope to comprise a one-piece member, and forming said protective envelope with integral clip means thereon for holding said lead means adjacent to said protective envelope.

4. In a method of making an electrical switch construction having an electrical switch assembly disposed in a protective envelope and having lead means extending from said assembly and projecting externally from said envelope out through opening means in one end of said envelope, the improvement comprising the steps of forming a removable end closure to be carried by said envelope and close said opening means of said one end thereof, forming said end closure with aperture means therethrough, removably disposing said lead means through said aperture means whereby said switch assembly is adapted to be carried by said end closure away from said protective envelope when said end closure is removed from said one end of said protective envelope and said switch assembly is adapted to be removed from said end closure by pulling said lead means out of said aperture means thereof, forming said protective envelope to comprise a one-piece member, forming said protective envelope with integral locating surface means thereon, and forming said locating surface means to comprise an elongated tapering abutment on said protective envelope.

* * * * *